US010665162B2

(12) United States Patent
Lee et al.

(10) Patent No.: US 10,665,162 B2
(45) Date of Patent: May 26, 2020

(54) PIXEL AND ORGANIC LIGHT-EMITTING DISPLAY DEVICE INCLUDING THE SAME

(71) Applicant: Samsung Display Co. Ltd., Yongin-si, Gyeonggi-do (KR)

(72) Inventors: Hyo Chul Lee, Yongin-si (KR); Yoon Jung Chai, Yongin-si (KR)

(73) Assignee: Samsung Display Co., Ltd. (KR)

( * ) Notice: Subject to any disclaimer, the term of this patent is extended or adjusted under 35 U.S.C. 154(b) by 7 days.

(21) Appl. No.: 15/984,175

(22) Filed: May 18, 2018

(65) Prior Publication Data

US 2019/0096323 A1 Mar. 28, 2019

(30) Foreign Application Priority Data

Sep. 28, 2017 (KR) ..... 10-2017-0126286

(51) Int. Cl.
*G09G 3/3233* (2016.01)

(52) U.S. Cl.
CPC ... *G09G 3/3233* (2013.01); *G09G 2300/0819* (2013.01); *G09G 2300/0852* (2013.01); *G09G 2300/0861* (2013.01); *G09G 2310/0262* (2013.01); *G09G 2320/0233* (2013.01); *G09G 2320/0295* (2013.01); *G09G 2320/045* (2013.01)

(58) Field of Classification Search
CPC combination set(s) only.
See application file for complete search history.

(56) References Cited

U.S. PATENT DOCUMENTS

2013/0099692 A1* 4/2013 Chaji ..... H05B 37/02 315/224
2017/0124939 A1* 5/2017 Kang ..... H01L 27/3262
2017/0193896 A1 7/2017 Kim
2017/0200414 A1* 7/2017 Li ..... G09G 3/3258
2018/0006263 A1* 1/2018 Yoon ..... H01L 51/0508
2019/0005877 A1* 1/2019 Dong ..... G09G 3/3208

FOREIGN PATENT DOCUMENTS

KR 10-2016-0094129 A 9/2016
KR 10-2017-0080737 A 7/2017

* cited by examiner

*Primary Examiner* — Van N Chow
(74) *Attorney, Agent, or Firm* — Innovation Counsel LLP

(57) ABSTRACT

A pixel of an organic light emitting diode (OLED) display device may include an organic light-emitting diode; a first transistor configured to control, in response to a voltage of a first node, current flowing from a first driving power source to a second driving power source that is coupled to a second node via the organic light-emitting diode; a second transistor coupled between a data line and the first node, and configured to be turned on when a first scan signal is supplied to a first scan line; a storage capacitor coupled between the first node and the first driving power source; and an auxiliary capacitor coupled between the first driving power source and the second node.

17 Claims, 4 Drawing Sheets

PIXEL AND ORGANIC LIGHT-EMITTING DISPLAY DEVICE INCLUDING THE SAME

CROSS-REFERENCE TO RELATED APPLICATION

The present application claims priority to Korean patent application number 10-2017-0126286 filed on Sep. 28, 2017, the entire disclosure of which is incorporated by reference herein in its entirety.

BACKGROUND

Field of Invention

Various embodiments of the present disclosure relate to a pixel and an organic light-emitting display device including the pixel, and more particularly, to a pixel capable of improving the display quality, and an organic light-emitting display device including the pixel.

Description of Related Art

With the development of information technology, the importance of a display device that provides an interface between a user and information has been emphasized. Owing to the importance of the display device, the use of various types of display devices, such as a liquid crystal display (LCD) device and an organic light-emitting display (OLED) device, has increased.

Among the various types of display devices, an organic light-emitting display device displays an image using an organic light-emitting diode that emits light via re-coupling of electrons and holes. The organic light-emitting display device has an advantage in that it has a high response speed and is operated with low power consumption.

The organic light-emitting display device includes pixels that are coupled with data lines and scan lines. Each of the pixels generally includes an organic light-emitting diode, and a driving transistor for controlling the amount of current flowing through the organic light-emitting diode. The driving transistor controls, in response to a data signal, current flowing from a first driving power source to a second driving power source via the organic light-emitting diode. The organic light-emitting diode may generate light having a predetermined luminance in response to the current flow controlled by the driving transistor.

Although the organic light-emitting display device has an advantage of low power consumption, current flowing through the organic light-emitting diode may be changed depending on deviation in the threshold voltage of the driving transistor included in each of the pixels, causing display unevenness.

Furthermore, the luminance of the organic light-emitting diode may be changed by variation in efficiency due to deterioration. In fact, the organic light-emitting diode (OLED) deteriorates by lapse of time. Consequently, the luminance of light corresponding to the same data signal is gradually reduced over time.

SUMMARY

Various embodiments of the present disclosure are directed to a pixel capable of improving the display quality and an organic light-emitting display device including the pixel.

An embodiment of the present disclosure provides a pixel including: an organic light-emitting diode; a first transistor configured to control, in response to a voltage of a first node, current flowing from a first driving power source to a second driving power source coupled to a second node via the organic light-emitting diode; a second transistor coupled between a data line and the first node, and configured to be turned on when a scan signal is supplied to a first scan line; a storage capacitor coupled between the first node and the first driving power source; and an auxiliary capacitor coupled between the first driving power source and the second node.

In an embodiment, a capacitance of the auxiliary capacitor may be set to a capacitance identical to that of the storage capacitor.

In an embodiment, the pixel may further include a third transistor coupled between the second node and the data line, and configured to be turned on when a sensing control signal is supplied to a sensing control line.

In an embodiment, the pixel may further include a fourth transistor coupled between the first node and the second node, and configured to be turned on when a scan signal is supplied to the first scan line.

In an embodiment, the pixel may further include an emission control transistor coupled between the first driving power source and the second driving power source, and configured to be turned on when an emission control signal is supplied to an emission control line, and control current flowing via the first transistor.

In an embodiment, the emission control transistor may include a fifth transistor coupled between the first driving power source and the first node, and a sixth transistor coupled between the second node and the second driving power source.

In an embodiment, the pixel may further include a seventh transistor coupled between the first node and a third driving power source, and configured to be turned on when a scan signal is supplied to a third scan line.

In an embodiment, the pixel may further include an eighth transistor coupled between the third driving power source and an anode electrode of the organic light-emitting diode, and configured to be turned on when a scan signal is supplied to the first scan line.

In an embodiment, at least one of the first to eighth transistors may be formed of a P-type transistor.

In an embodiment, at least one of the first to eighth transistors may be formed of an oxide semiconductor transistor.

An embodiment of the present disclosure provides an organic light-emitting display device including: pixels disposed at intersections of data lines, scan lines and sensing control lines, each of the pixels including an organic light-emitting diode; a sensor configured to sense electrical characteristics of each of the pixels during a sensing period, and extract electrical characteristic information therefrom; and a converter configured to generate second data by changing first data using the electrical characteristic information. A pixel coupled to an i-th scan line (i is a natural number) and a j-th data line (j is a natural number) among the pixels may include: a first transistor configured to control, in response to a voltage of a first node, current flowing from a first driving power source to a second driving power source coupled to a second node via the organic light-emitting diode; a second transistor coupled between the j-th data line and the first node, and configured to be turned on when a scan signal is supplied to the i-th scan line; a storage capacitor coupled between the first node and the first driving power source; and an auxiliary capacitor coupled between the first driving power source and the second node.

In an embodiment, a capacitance of the auxiliary capacitor may be set to a capacitance identical to that of the storage capacitor.

In an embodiment, the pixel coupled to the i-th scan line and the j-th data line may further include a third transistor coupled between the second node and the j-th data line, and configured to be turned on when a sensing control signal is supplied to an i-th sensing control line.

In an embodiment, the sensor may include an analog-digital converter configured to convert the electrical characteristic information into a digital value, and a memory configured to store the digital value.

In an embodiment, the organic light-emitting display device may further include a scan driver configured to drive the scan lines; a data driver configured to drive the data lines; a sensing control driver configured to drive the sensing control lines; and a switch configured to couple the data lines to at least one of the sensor and the data driver.

In an embodiment, the switch may include first switches coupled between the respective data lines and the data driver, and second switches coupled between the respective data lines and the sensor.

In an embodiment, during the sensing period for which the electrical characteristic information of the pixel coupled to the i-th scan line and the j-th data line is extracted, the switch may couple the data lines to the data driver during a first period of the sensing period and couple the data lines to the sensor during a second period of the sensing period, the scan driver may supply a scan signal to the i-th scan line during the first period, and the sensing control driver may supply a sensing control signal to the i-th sensing control line during the second period.

In an embodiment, the data driver may supply a reference data signal capable of turning on the first transistor to the data lines during the first period.

In an embodiment, feedback current supplied from the first transistor to the data lines during the second period may be the electrical characteristic information.

In an embodiment, at least one of the first transistor and the second transistor may be formed of a P-type transistor.

BRIEF DESCRIPTION OF THE DRAWINGS

Example embodiments will now be described more fully hereinafter with reference to the accompanying drawings; however, they may be embodied in different forms and should not be construed as limited to the example embodiments set forth herein. Rather, these example embodiments are provided so that the present disclosure will be thorough and complete, and will fully convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION

Figure 1:
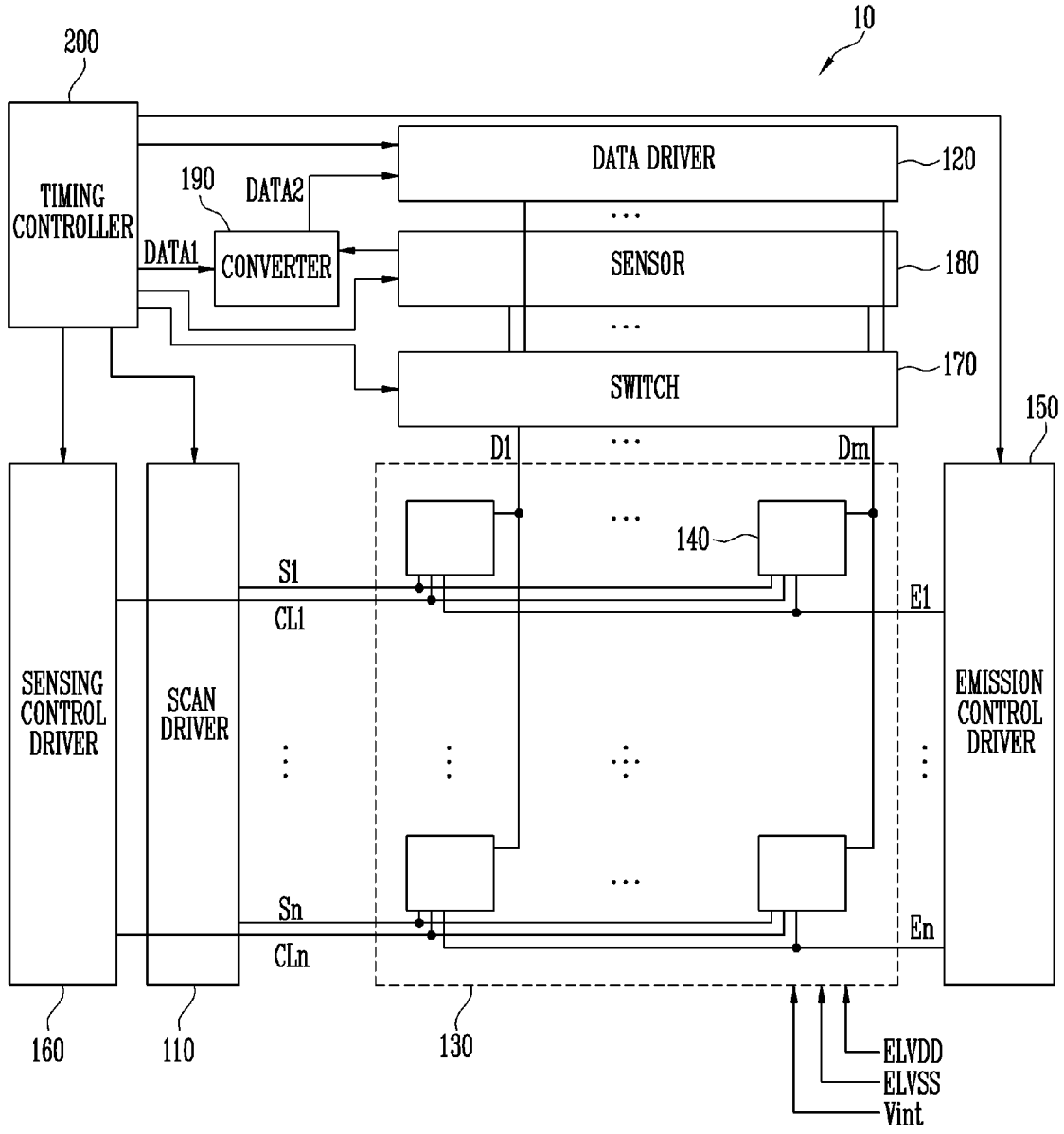
FIG. 1 is a diagram illustrating an organic light-emitting display device in accordance with an embodiment of the present disclosure.

Hereinafter, embodiments will be described in greater detail with reference to the accompanying drawings. Embodiments are described herein with reference to cross-sectional illustrations that are schematic illustrations of embodiments (and intermediate structures). As such, variations from the forms and/or shapes of the illustrations as a result, for example, of manufacturing techniques and/or tolerances, are to be expected. Thus, embodiments should not be construed as limited to the particular forms and/or shapes of regions illustrated herein but may include deviations in forms and/or shapes that result, for example, from manufacturing. In the drawings, lengths and sizes of layers and regions may be exaggerated for clarity. Like reference numerals in the drawings denote like elements.

Terms such as 'first' and 'second' may be used to describe various components, but they should not be construed as limiting to the various components. Instead, those terms are only used for the purpose of differentiating a component from other components. For example, a first component may be referred to as a second component, and a second component may be referred to as a first component and so forth without departing from the spirit and scope of the present disclosure. Furthermore, 'and/or' may include any one of or a combination of the components mentioned.

Furthermore, a singular form may include a plural from as long as it is explicitly mentioned otherwise. Furthermore, "include/comprise" or "including/comprising" used in the specification represents that one or more components, steps, operations, and elements exist or can be added.

Furthermore, unless defined otherwise, the terms used in the present disclosure including technical and scientific terms have the same meanings as would be generally understood by those skilled in the related art. The terms defined in generally used dictionaries should be construed as having the same meanings as would be construed in the context of a related art, and unless clearly defined otherwise in the present disclosure, should not be construed as having idealistic or overly formal meanings.

It is also noted that in the present disclosure, "connected/coupled" refers to one component not only directly coupling another component but also indirectly coupling another component through an intermediate component. On the other hand, "directly connected/directly coupled" refers to one component directly coupling another component without an intermediate component.

FIG. 1 is a diagram illustrating an organic light-emitting display device 10 in accordance with an embodiment of the present disclosure. Referring to FIG. 1, the organic light emitting display device 10 may include a scan driver 110, a data driver 120, a pixel unit 130, an emission control driver 150, a sensing control driver 160, a switch 170, a sensor 180, a converter 190, and a timing controller 200.

A period for which the organic light-emitting display device 10 according to an embodiment of the present disclosure is operated may be divided into a sensing period and a driving period. The sensing period may be a period for which electrical characteristic information of pixels 140 included in the pixel unit 130 is extracted. The driving period may be a period for which a predetermined image is displayed. For example, the electrical characteristic information of each pixel may include deterioration information of an organic light-emitting diode included in the corresponding pixel, and/or deviation information of a driving transistor included in the corresponding pixel. The deviation information of the driving transistor may refer to information including a threshold voltage and mobility of the driving transistor.

The scan driver 110 may drive scan lines S1 to Sn (n is a natural number). The scan driver 110 may supply scan signals to the scan lines S1 to Sn during the sensing period and the driving period under control of the timing controller 200. For example, the scan driver 110 may sequentially provide scan signals to the scan lines S1 to Sn.

When the scan signals are sequentially provided to the scan lines S1 to Sn, the pixels 140 may be selected on a horizontal line basis. Here, the scan signals may be set to a gate-on voltage so that driving transistors included in the pixels 140 can be turned on.

The data driver 120 may drive data lines D1 to Dm (m is a natural number). The data driver 120 may supply a reference data signal to the data lines D1 to Dm during the sensing period for which the electrical characteristic information of the pixels is extracted. The reference data signal may have a voltage at which current can flow through the corresponding driving transistor, and be set to any one of reference data signals that can be provided from the data driver 120.

The data driver 120 may receive second data DATA2 from the converter 190 during the driving period, and generate data signals using the received second data DATA2. The data signals generated from the data driver 120 may be supplied to the data lines D1 to Dm. More specifically, the data signals supplied to the data lines D1 to Dm may be supplied to pixels 140 selected by a scan signal, and each pixel 140 may generate light having a predetermined luminance in response to the corresponding data signal.

The pixel unit 130 may refer to a display area in which an image is displayed. The pixel unit 130 may include the pixels 140 disposed in areas defined by the scan lines S1 to Sn, the data lines D1 to Dm, emission control lines E1 to En, and sensing control lines CL1 to CLn.

The pixels 140 may be supplied with a first driving power source ELVDD, a second driving power source ELVSS, and a third driving power source Vint from one or more external devices. Each pixel 140 may be selected when a scan signal is supplied, and store a voltage corresponding to an associated data signal. Each pixel 140 may control, in response to a data signal, current to be supplied from the first driving power source ELVDD to the second driving power source ELVSS via the organic light-emitting diode.

The pixel 140 may control, regardless of a voltage drop of the first driving power source ELVDD, current flowing through the organic light-emitting diode.

The emission control driver 150 may drive the emission control lines E1 to En. The emission control driver 150 may supply emission control signals to the emission control lines E1 to En during the sensing period and the driving period under control of the timing controller 200. For example, the emission control driver 150 may sequentially provide emission control signals to the emission control lines E1 to En. Here, the emission control signals may be set to a gate-on voltage so that the driving transistors included in the pixels 140 can be turned on.

The sensing control driver 160 may drive the sensing control lines CL1 to CLn. The sensing control driver 160 may supply sensing control signals to the sensing control lines CL1 to CLn during the sensing period under control of the timing controller 200. For example, the sensing control driver 160 may sequentially provide sensing control signals to the sensing control lines CL1 to CLn. Here, the sensing control signals may be set to a gate-on voltage so that the driving transistors included in the pixels 140 can be turned on.

The switch 170 may couple the data lines D1 to Dm to the data driver 120 or the sensor 180. The switch 170 may couple the data lines D1 to Dm to the data driver 120 or the sensor 180 during the sensing period. Further, the switch 170 may couple the data lines D1 to Dm to the data driver 120 during the driving period. Then, data signals may be supplied from the data driver 120 to the data lines D1 to Dm during the driving period.

The sensor 180 may extract electrical characteristic information of the pixels 140 during the sensing period. The sensor 180 may convert the extracted information into a digital value and store the digital value in a memory (not shown).

The converter 190 may generate the second data DATA2 by changing first data DATA1 inputted from the timing controller 200 in response to the electrical characteristic information (i.e., in response to the digital value stored in the memory of the sensor 180) provided from the sensor 180. The second data DATA2 may be set to compensate for the electrical characteristics of the pixels 140. The second data DATA2 generated from the converter 190 may be provided to the data driver 120.

The timing controller 200 may control the scan driver 110, the data driver 120, the emission control driver 150, the sensing control driver 160, the switch 170, the sensor 180, and the converter 190. Furthermore, the timing controller 200 may rearrange the first data DATA1 supplied from an external device and supply the rearrange first data to the converter 190.

In FIG. 1, the sensor 180 and the converter 190 are illustrated as being disposed outside the timing controller 200, but the present disclosure is not limited thereto. In an embodiment, the sensor 180 and the converter 190 may be disposed in the timing controller 200.

Figure 2:
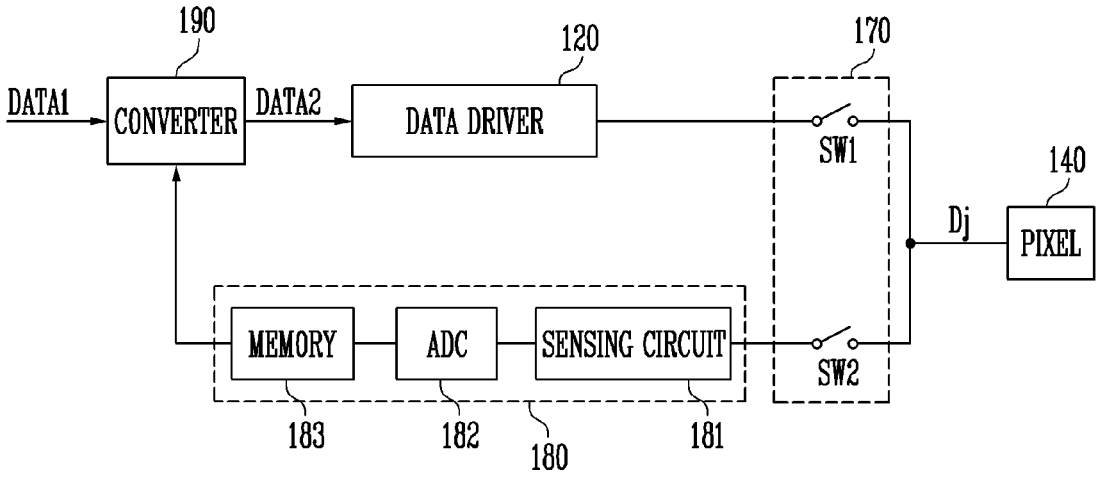
FIG. 2 is a diagram illustrating a switch and a sensor in accordance with an embodiment of the present disclosure.

FIG. 2 is a diagram illustrating the switch 170 and the sensor 180 in accordance with an embodiment of the present disclosure.

For the sake of explanation, FIG. 2 illustrates the coupling of the switch 170 to the data driver 120 and the sensor 180 to connect to the pixel 140 with a j-th data line Dj.

Referring to FIGS. 1 and 2, the switch 170 may include switches SW1 and SW2 disposed in each channel. In other words, the switches SW1 and SW2 may be coupled with each of the data lines D1 to Dm.

The first switch SW1 may be disposed between the data driver 120 and the data line Dj. The first switch SW1 may remain turned on during the driving period. The first switch SW1 may be turned on and off alternately with the second switch SW2 during the sensing period.

The second switch SW2 may be disposed between the sensor 180 and the data line Dj. The second switch SW2 may remain turned off during the driving period. The second switch SW2 may be turned on and off alternately with the first switch SW1 during the sensing period. In addition, the first switch SW1 and the second switch SW2 may be turned on and off under control of the timing controller 200.

The sensor 180 may include a sensing circuit 181, an analog-digital converter 182 (hereinafter, referred to as "ADC") and a memory 183. In some embodiments, the memory 183 may be an external memory to the sensor 180.

The sensing circuit 181 may supply the electrical characteristic information extracted from the pixel 140 to the ADC 182. For example, the sensing circuit 181 may convert the electrical characteristic information supplied as current into a voltage, and supply the voltage to the ADC 182. Furthermore, the sensing circuit 181 may supply a reference voltage or a reference current to the data line Dj to extract the electrical characteristic information from the pixel 140. The sensing circuit 181 may be formed in each channel, or be shared with a plurality of channels.

The ADC 182 may convert the electrical characteristic information supplied from the sensing circuit 181 into a digital value and supply the digital value to the memory 183. The ADC 182 may be formed in each channel, or be shared with a plurality of channels.

The memory 183 may store the digital value supplied from the ADC 182. For instance, the electrical characteristic information of each pixel 140 may be stored as a digital value in the memory 183.

The converter 190 may generate the second data DATA2 by changing the first data DATA1 to compensate for the electrical characteristics of the pixel 140 using the digital value stored in the memory 183 of the sensor 180.

Figure 3:
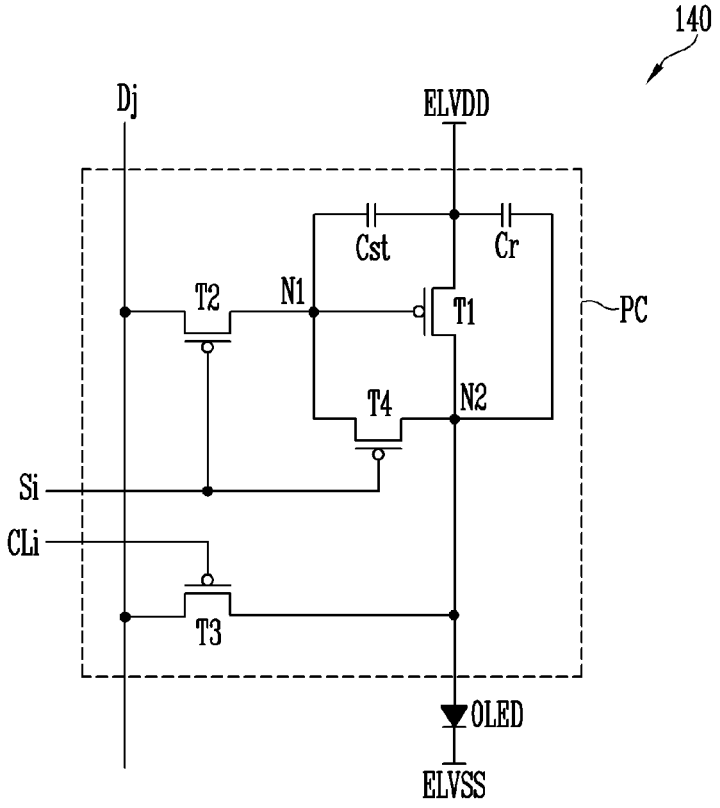
FIG. 3 is a diagram illustrating a pixel in accordance with one embodiment of the present disclosure.
Figure 4:
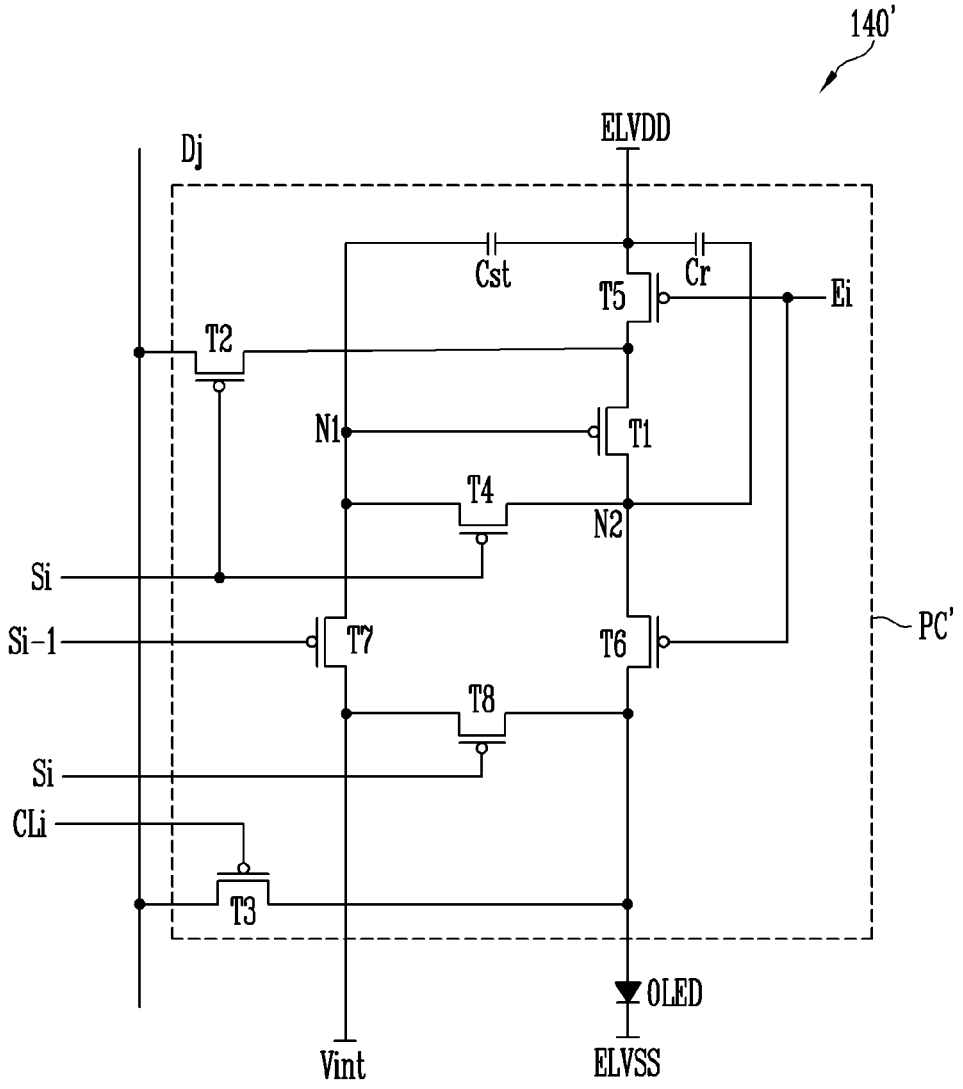
FIG. 4 is a diagram illustrating a pixel in accordance with another embodiment of the present disclosure.

FIG. 3 is a diagram illustrating the pixel 140 in accordance with one embodiment of the present disclosure. FIG. 4 is a diagram illustrating a pixel 140' in accordance with another embodiment of the present disclosure. In particular, for the sake of explanation, FIGS. 3 and 4 respectively illustrate the pixels 140 and 140', each of which is coupled with an i-th scan line Si (i is a natural number) of the scan lines S1 to Sn, an i-th sensing control line CLi of the sensing control lines CL1 to CLn, and the j-th data line Dj (j is a natural number) of the data lines D1 to Dm.

The following description may also be applied to the other pixels shown in FIG. 1.

FIGS. 3 and 4 illustrate a case where a light emitting element of the pixel 140 and 140' is an organic light-emitting diode OLED.

Referring to FIG. 3, the pixel 140 may include an organic light-emitting diode OLED and a pixel circuit PC.

An anode electrode of the organic light-emitting diode OLED may be coupled to the pixel circuit PC, and a cathode electrode of the organic light-emitting diode OLED may be coupled to the second driving power source ELVSS. The organic light-emitting diode OLED may generate light having a predetermined luminance corresponding to current supplied from the pixel circuit PC.

The pixel circuit PC may be coupled with the i-th scan line Si, the i-th sensing control line CLi, and the j-th data line Dj, and control the organic light-emitting diode OLED.

The pixel circuit PC may store a data signal to be supplied to the j-th data line Dj when a scan signal is supplied to the i-th scan line Si. The pixel circuit PC may control current to be supplied to the organic light-emitting diode OLED in response to the stored data signal.

For example, the pixel circuit PC may include a first transistor T1, a second transistor T2, a third transistor T3, a storage capacitor Cst, and an auxiliary capacitor Cr.

The first transistor T1 may be coupled between the first driving power source ELVDD and the anode electrode of the organic light-emitting diode OLED. The first transistor T1 may be a driving transistor, and control, in response to a voltage of a first node N1 (that is, a voltage value stored in the storage capacitor Cst), current flowing from the first driving power source ELVDD to the second driving power source ELVSS that is coupled with a second node N2 via the organic light-emitting diode OLED. For example, a gate electrode of the first transistor T1 may be coupled both to a first electrode of the storage capacitor Cst and to a second electrode of the second transistor T2 at the first node N1. A first electrode of the first transistor T1 may be coupled both to a second electrode of the storage capacitor Cst and to the first driving power source ELVDD. A second electrode of the first transistor T1 may be coupled to the anode electrode of the organic light-emitting diode OLED.

Here, the organic light-emitting diode OLED may generate light corresponding to current supplied from the first transistor T1.

The second transistor T2 may be coupled between the j-th data line Dj and the gate electrode of the first transistor T1.

A gate electrode of the second transistor T2 may be coupled to the i-th scan line Si. A first electrode of the second transistor T2 may be coupled to the j-th data line Dj. A second electrode of the second transistor T2 may be coupled to the gate electrode of the first transistor T1. When a scan signal is supplied to the i-th scan line Si, the second transistor T2 is turned on so that a data signal can be supplied from the j-th data line Dj to the storage capacitor Cst and/or the auxiliary capacitor Cr.

The third transistor T3 may be coupled between the j-th data line Dj and the anode electrode of the organic light-emitting diode OLED. A gate electrode of the third transistor T3 may be coupled to the i-th sensing control line CLi. A first electrode of the third transistor T3 may be coupled to the anode electrode of the organic light-emitting diode OLED. A second electrode of the third transistor T3 may be coupled to the j-th data line Dj. When a sensing control signal is supplied to the i-th sensing control line CLi, the third transistor T3 is turned on to electrically couple the j-th data line Dj to the anode electrode of the organic light-emitting diode OLED, thus allowing feedback current pertaining to the electrical characteristic information of the pixel 140 to flow therethrough.

A fourth transistor T4 may be coupled between the first node N1 and the second node N2. A gate electrode of the fourth transistor T4 may be coupled to the i-th scan line Si. A first electrode of the fourth transistor T4 may be coupled to the second node N2. A second electrode of the fourth transistor T4 may be coupled to the first node N1. When a scan signal is supplied to the i-th scan line Si, the fourth transistor T4 is turned on to electrically couple the first node N1 with the second node N2. Therefore, when the fourth transistor T4 is turned on, the first transistor T1 may be connected in the form of a diode.

The storage capacitor Cst may be coupled between the first driving power source ELVDD and the first node N1. The storage capacitor Cst may be charged in response to the data signal supplied from the j-th data line Dj when the scan signal is supplied to the i-th scan line Si turning on the second transistor T2.

The auxiliary capacitor Cr may be coupled between the first driving power source ELVDD and the second node N2. The auxiliary capacitor Cr may be charged in response to the data signal supplied from the j-th data line Dj when the scan signal is supplied to the i-th scan line Si turning on the second transistor T2.

In an embodiment, the capacitance of the auxiliary capacitor Cr may be set to the same capacitance as that of the storage capacitor Cst. In this case, the auxiliary capacitor Cr may be charged at the same rate as that of the storage capacitor Cst in response to the data signal supplied from the j-th data line Dj when the scan signal is supplied to the i-th scan line Si turning on the second transistor T2.

Consequently, when a noise signal is included in the first driving power source ELVDD, the noise signal may be transmitted to each of the first node N1 and the second node N2 at the same rate.

In this case, a difference in voltage between the gate electrode and a drain electrode of the first transistor T1 may remain constant. Consequently, feedback current flowing from the first transistor T1 may be prevented from being affected by the noise signal.

Here, the first electrode of each of the transistors T1, T2, T3, and T4 may be set to any one of a source electrode and a drain electrode, and the second electrode of each of the transistors T1, T2, T3 and T4 may be set to an electrode different from the first electrode. For example, if the first electrode is set to a source electrode, the second electrode may be set to a drain electrode.

Furthermore, FIG. 3 illustrates an example in which the transistors T1, T2, T3, and T4 are P-type transistors, but in various embodiment, each of the transistors T1, T2, T3, and T4 may be embodied as either an N-type transistor or a P-type transistor.

The voltage of the second driving power source ELVSS may be set to a voltage lower than that of the first driving power source ELVDD.

Referring to FIG. 4, the pixel 140' may include an organic light-emitting diode OLED, and a pixel circuit PC' configured to control the organic light-emitting diode OLED.

An anode electrode of the organic light-emitting diode OLED may be coupled to the pixel circuit PC', and a cathode electrode of the organic light-emitting diode OLED may be coupled to the second driving power source ELVSS.

The pixel circuit PC' may include first to eighth transistors T1 to T8, a storage capacitor Cst, and an auxiliary capacitor Cr.

To avoid redundancy of explanation, the description of the pixel 140' shown in FIG. 4 will be focused on differences from the pixel 140 shown in FIG. 3.

A first electrode of the first transistor Ti may be coupled to the first driving power source ELVDD via a fifth transistor T5, and a second electrode of the first transistor T1 may be coupled to the anode electrode of the organic light-emitting diode OLED via a sixth transistor T6.

A gate electrode of the first transistor T1 may be coupled to a first node N1. The first transistor T1 may control, in response to a voltage of the first node N1, current flowing from the first driving power source ELVDD to the second driving power source ELVSS via the organic light-emitting diode OLED.

The fifth transistor T5 and the sixth transistor T6 may be emission control transistors coupled between the first driving power source ELVDD and the second driving power source ELVSS. When an emission control signal is supplied to an emission control line Ei, the emission control transistors T5 and T6 may be turned on to control current flowing via the first transistor T1.

The fifth transistor T5 may be coupled between the first driving power source ELVDD and the first transistor T1. For example, a gate electrode of the fifth transistor T5 may be coupled to an i-th emission control line Ei. A first electrode of the fifth transistor T5 may be coupled to the first driving power source ELVDD. A second electrode of the fifth transistor T5 may be coupled to the first electrode of the first transistor T1.

The sixth transistor T6 may be coupled between the first transistor T1 and the anode electrode of the organic light-emitting diode OLED. For example, a gate electrode of the sixth transistor T6 may be coupled to the i-th emission control line Ei. A first electrode of the sixth transistor T6 may be coupled to the second electrode of the first transistor at the second node N2. A second electrode of the sixth transistor T6 may be coupled to the anode electrode of the organic light-emitting diode OLED.

A seventh transistor T7 may be coupled between the first node N1 and a third driving power source Vint. A gate electrode of the seventh transistor T7 may be coupled to an i−1-th scan line Si-1. A first electrode of the seventh transistor T7 may be coupled to the first node N1. A second electrode of the seventh transistor T7 may be coupled to the third driving power source Vint. When a scan signal is supplied to the i−1-th scan line Si-1, the seventh transistor T7 is turned on to electrically couple the first node N1 to the third driving power source Vint. Therefore, when the seventh transistor T7 is turned on, the first node N1 may receive the voltage of the third driving power source Vint.

The eighth transistor T8 may be coupled between the third driving power source Vint and the anode electrode of the organic light-emitting diode OLED. A gate electrode of the eighth transistor T8 may be coupled to an i-th scan line Si. A first electrode of the eighth transistor T8 may be coupled to the anode electrode of the organic light-emitting diode OLED. A second electrode of the eighth transistor T8 may be coupled to the third driving power source Vint. When a scan signal is supplied to the i-th scan line Si, the eighth transistor T8 is turned on to electrically couple the third driving power source Vint to the anode electrode of the organic light-emitting diode OLED. Therefore, when the eighth transistor T8 is turned on, the anode electrode of the organic light-emitting diode OLED may receive the voltage of the third driving power source Vint.

In one embodiment, the voltage of the third driving power source Vint may be set to a voltage lower than that of a data signal.

In another embodiment, the third driving power source Vint may be the same power source as an initialization power source or the second driving power source ELVSS.

The anode electrode of the organic light-emitting diode OLED may be coupled to the first transistor T1 via the sixth transistor T6, and a cathode electrode of the organic light-emitting diode OLED may be coupled to the second power source ELVSS. The organic light-emitting diode OLED may generate light having a predetermined luminance corresponding to current flowing through the first transistor T1 in response to a voltage of the first node N1 and when an emission control signal is supplied to the emission control line Ei turning on both the fifth transistor T5 and the sixth transistor T6.

The voltage of the first driving power source ELVDD may be set to a voltage higher than that of the second driving power source ELVSS so that current can flow through the organic light-emitting diode OLED. For example, the voltage of the first driving power source ELVDD may be set to a positive voltage, and the voltage of the second driving power source ELVSS may be set to a negative voltage or a ground voltage.

Here, the first electrode of each of the transistors T1, T2, T3, T4, T5, T6, T7, and T8 may be set to any one of a source electrode and a drain electrode, and the second electrode of each of the transistors T1, T2, T3, T4, T5, T6, T7, and T8 may be set to an electrode different from the first electrode. For example, if the first electrode is set to a source electrode, the second electrode may be set to a drain electrode.

Furthermore, FIG. 4 illustrates an example in which the transistors T1, T2, T3, T4, T5, T6, T7, and T8 are P-type transistors, but in various embodiment, each of the transistors T1, T2, T3, T4, T5, T6, T7, and T8 may be embodied as either an N-type transistor or a P-type transistor.

In some embodiments, at least one of the transistors T1, T2, T3, T4, T5, T6, T7, and T8 may be formed of a P-type transistor.

In another embodiment, at least one of the transistors T1, T2, T3, T4, T5, T6, T7, and T8 may be formed of an oxide semiconductor transistor.

The above-described pixel structure of FIGS. 3 and 4 is an example embodiment of the present disclosure, and the pixel 140 and 140' of the present disclosure is not limited to having the illustrated pixel structure. Substantially, the pixel 140 and 140' has a circuit structure capable of supplying current through the organic light-emitting diode OLED, and any one of various well-known structures may be selected as the structure of the pixel 140 and 140'.

Figure 5:
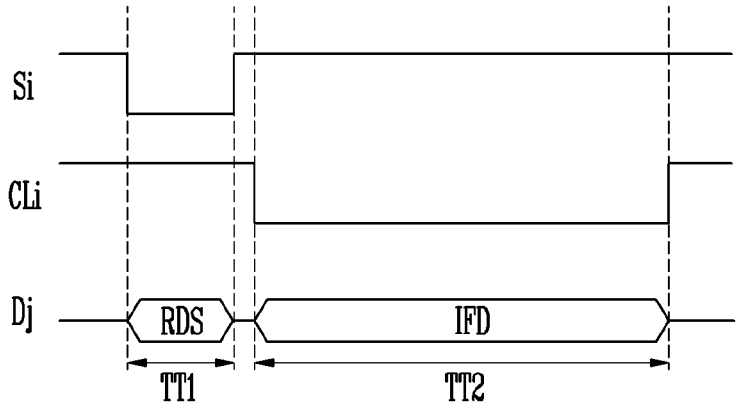
FIG. 5 is a waveform diagram illustrating extraction of electrical characteristic information of the pixel during a sensing period, according to an embodiment of the present disclosure.

FIG. 5 is a waveform diagram illustrating extraction of the electrical characteristic information of the pixel during a sensing period, according to an embodiment of the present disclosure. With reference to FIG. 5, a driving process will be described using a pixel coupled with the i-th scan line Si and the j-th data line Dj.

Referring to FIGS. 2, 3, and 5, during a first period TT1, the first switch SW1 may be turned on, and a scan signal may be supplied to the i-th scan line Si.

When the scan signal is supplied to the i-th scan line Si, the second transistor T2 and the fourth transistor T4 may be turned on. When the second transistor T2 is turned on, the j-th data line Dj may be electrically coupled to the first node N1. When the fourth transistor T4 is turned on, the first node N1 may be electrically coupled to the second node N2.

When the first switch SW1 is turned on, the data driver 120 may be electrically coupled to the data line Dj. Then, a reference data signal RDS may be supplied from the data driver 120 to the first node N1 and the second node N2 of the pixel 140 via the data line Dj.

When the reference data signal RDS is supplied to the first node N1 and the second node N2, the storage capacitor Cst and the auxiliary capacitor Cr may charge a voltage corresponding to a difference in voltage between the reference data signal RDS and the first driving power source ELVDD.

During a second period TT2, the first switch SW1 is turned off and the second switch SW2 is turned on, and a sensing control signal may be supplied to the i-th sensing control line CLi.

When the sensing control signal is supplied to the i-th sensing control line CLi, the third transistor T3 may be turned on. When the third transistor T3 is turned on, the anode electrode of the organic light-emitting diode OLED may be electrically coupled to the j-th data line Dj.

When the second switch SW2 is turned on, the sensor 180 may be electrically coupled to the j-th data line Dj. Then, feedback current IFD flowing through the third transistor T3 may be supplied to the sensor 180. Here, the feedback current IFD may be used as electrical characteristic information of the pixel 140 coupled with the i-th scan line Si and the j-th data line Dj.

When a noise signal is included in the first driving power source ELVDD, the noise signal may be transmitted to each of the first node N1 and the second node N2 at the same rate.

In this case, a difference in voltage between the gate electrode and a drain electrode of the first transistor T1 may remain constant. Consequently, the feedback current IFD may be prevented from being affected by the noise signal.

In more detail, the feedback current IFD flowing through the third transistor T3 during the second period TT2 may be determined in response to the reference data signal RDS. The feedback current IFD flowing in response to the reference data signal RDS may be changed depending on the electrical characteristics of the pixel 140. In other words, the feedback current IFD flowing through the third transistor T3 during the second period TT2 may include information associated with the electrical characteristics of the pixel 140.

During the second period TT2, the sensing circuit 181 may supply the feedback current IFD to the ADC 182. Alternatively, the sensing circuit 181 may convert the feedback current IFD into a voltage and supply the converted voltage to the ADC 182.

The ADC 182 may convert the feedback current IFD or the voltage supplied from the sensing circuit 181 into a digital value as the electrical characteristic information, and supply the converted digital value to the memory 183.

The memory 183 may store the digital value supplied from the ADC 182 as electrical characteristic information of a corresponding pixel.

In addition, the sensing period for which electrical characteristic information is extracted may be included at least once before the organic light-emitting display device is marketed.

Furthermore, the sensing period may be included at a predetermined time after the organic light-emitting display device has been marketed.

In accordance with a pixel and an organic light-emitting display device including the pixel according to an embodiment of the present disclosure, the electrical characteristics of the pixel may be compensated for by an external device provided outside the pixel, whereby the display quality of the organic light-emitting display device may be improved.

In the pixel according to the present disclosure, current flowing through the driving transistor may be maintained constant regardless of a noise signal (e.g., a change in voltage) of a first driving power source ELVDD. Consequently, the display quality may be improved.

Example embodiments have been disclosed herein, and although specific terms are employed, they are used and are to be interpreted in a generic and descriptive sense and not for purpose of limitation. In some instances, as would be apparent to one of ordinary skill in the art, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present disclosure as set forth in the following claims.

What is claimed is:

1. A pixel comprising:

an organic light-emitting diode;

a first transistor configured to control, in response to a voltage of a first node, current flowing from a first driving power source to a second driving power source that is coupled to a second node via the organic light-emitting diode;

a second transistor coupled between a data line and the first node, and configured to be turned on when a first scan signal is supplied to a first scan line;

a third transistor coupled between the second node and the data line, and configured to be turned on when a sensing control signal is supplied to a sensing control line;

a fourth transistor coupled between the first node and the second node, and configured to be turned on when the first scan signal is supplied to the first scan line;

a storage capacitor coupled between the first node and the first driving power source and charged corresponding to a voltage difference between the first node and first driving power source when the second transistor is turned on; and an auxiliary capacitor coupled between the first driving power source and the second node.

2. The pixel according to claim 1, wherein a capacitance value of the auxiliary capacitor is set to be identical to a capacitance value of the storage capacitor.

3. The pixel according to claim 1, further comprising one or more emission control transistors, each of the one or more emission control transistors being coupled between the first driving power source and the second driving power source, and configured to be turned on when an emission control signal is supplied to an emission control line, and controls current flowing via the first transistor.

4. The pixel according to claim 3, wherein the one or more emission control transistors comprise:

a fifth transistor coupled between the first driving power source and the first node; and a sixth transistor coupled between the second node and an anode of the organic light-emitting diode.

5. The pixel according to claim 4, further comprising a seventh transistor coupled between the first node and a third driving power source, and configured to be turned on when a second scan signal is supplied to a second scan line.

6. The pixel according to claim 5, further comprising an eighth transistor coupled between the third driving power source and the anode electrode of the organic light-emitting diode, and configured to be turned on when the first scan signal is supplied to the first scan line.

7. The pixel according to claim 6, wherein at least one of the first to eighth transistors is formed of a P-type transistor.

8. The pixel according to claim 6, wherein at least one of the first to eighth transistors is formed of an oxide semiconductor transistor.

9. An organic light-emitting display device comprising:

pixels disposed at intersections of data lines, scan lines, and sensing control lines, each of the pixels including an organic light-emitting diode;

a sensor configured to sense electrical characteristics of each of the pixels during a sensing period, and extract electrical characteristic information therefrom; and a converter configured to receive first data and generate second data based on the first data using the electrical characteristic information, wherein a pixel coupled to an i-th scan line (i is a natural number) and a j-th data line (j is a natural number) among the pixels comprises:

a first transistor configured to control, in response to a voltage of a first node, current flowing from a first driving power source to a second driving power source that is coupled to a second node via the organic light-emitting diode;

a second transistor coupled between the j-th data line and the first node, and configured to be turned on when a first scan signal is supplied to the i-th scan line;

a storage capacitor coupled between the first node and the first driving power source and charged corresponding to a voltage difference between the first node and first driving power source when the second transistor is turned on; and an auxiliary capacitor coupled between the first driving power source and the second node, wherein the pixel coupled to the i-th scan line and the j-th data line further comprises a third transistor coupled between the second node and the j-th data line, and configured to be turned on when a sensing control signal is supplied to an i-th sensing control line.

10. The organic light-emitting display device according to claim 9, wherein a capacitance value of the auxiliary capacitor is set to be identical to a capacitance value of the storage capacitor.

11. The organic light-emitting display device according to claim 9, wherein the sensor comprises:

an analog-digital converter configured to convert the electrical characteristic information into a digital value; and a memory configured to store the digital value.

12. The organic light-emitting display device according to claim 9, further comprising:

a scan driver configured to drive the scan lines;

a data driver configured to drive the data lines;

a sensing control driver configured to drive the sensing control lines; and a switch configured to couple the data lines to at least one of the sensor and the data driver.

13. The organic light-emitting display device according to claim 12, wherein the switch comprises:

first switches coupled between the respective data lines and the data driver; and second switches coupled between the respective data lines and the sensor.

14. The organic light-emitting display device according to claim 12, wherein, during the sensing period for which the electrical characteristic information of the pixel coupled to the i-th scan line and the j-th data line is extracted, the switch couples the data lines to the data driver during a first period of the sensing period, and couples the data lines to the sensor during a second period of the sensing period, and the scan driver supplies a scan signal to the i-th scan line during the first period, and the sensing control driver supplies a sensing control signal to the i-th sensing control line during the second period.

15. The organic light-emitting display device according to claim 14, wherein the data driver supplies a reference data signal capable of turning on the first transistor to the data lines during the first period.

16. The organic light-emitting display device according to claim 15, wherein feedback current flowing to the data lines during the second period includes the electrical characteristic information.

17. The organic light-emitting display device according to claim 9, wherein at least one of the first transistor and the second transistor is formed of a P-type transistor.

* * * * *